United States Patent [19]

Schoen

[11] Patent Number: 4,558,809

[45] Date of Patent: Dec. 17, 1985

[54] GRIPPER FEED SYSTEM FOR BLANKING PRESSES OR THE LIKE

[76] Inventor: Hans Schoen, Lange Horst 87, 4320 Hattingen, Fed. Rep. of Germany

[21] Appl. No.: 548,234

[22] Filed: Nov. 3, 1983

[30] Foreign Application Priority Data

Nov. 5, 1982 [DE] Fed. Rep. of Germany ..... 3240860

[51] Int. Cl.[4] ..... B65H 17/36; B65H 17/44

[52] U.S. Cl. ..... 226/162; 226/145; 226/146; 226/150

[58] Field of Search ..... 226/115, 144, 145, 146, 226/147, 149, 150, 151, 162, 163, 164, 165, 166, 167, 158, 159, 161

[56] References Cited

U.S. PATENT DOCUMENTS

| | | | |
|---|---|---|---|
| 2,929,626 | 3/1960 | Weymouth | 226/115 |
| 3,001,681 | 9/1961 | Wright | 226/150 |
| 3,094,925 | 6/1963 | Huber | 226/115 X |
| 3,429,493 | 2/1969 | Lehmann | 226/150 |
| 3,438,557 | 4/1969 | Lehmann | 226/165 X |
| 3,753,522 | 8/1973 | Voges | 226/162 X |
| 4,003,278 | 1/1977 | Shields | 226/150 X |
| 4,059,213 | 11/1977 | Toomay | 226/151 |
| 4,207,999 | 6/1980 | Scribner | 226/162 X |
| 4,223,821 | 6/1980 | McCall | 226/101 |

FOREIGN PATENT DOCUMENTS

| | | | |
|---|---|---|---|
| 846697 | 8/1952 | Fed. Rep. of Germany | 226/158 |
| 313629 | 12/1971 | U.S.S.R. | 226/158 |

*Primary Examiner*—Harvey C. Hornsby
*Assistant Examiner*—Scott J. Haugland
*Attorney, Agent, or Firm*—Thomas H. Murray; Clifford A. Poff

[57] ABSTRACT

Disclosed herein is an apparatus for moving material such as metal sheets or strip in production machines. The apparatus includes two spaced-apart, double-acting jacks disposed in parallel relation to the direction of movement for the strip. Each jack comprises two piston rods extending out of opposite ends of the cylinders from a common piston. The piston rods are secured at their free ends to standing columns arranged at the four corners of a rectangular base. A cross member rigidly interconnects the cylinders of the jacks and is provided with two transport grippers having jaws, one of which is moved by a jack to grip the strip at opposite sides thereof. The grippers are disposed in a plane containing the strip and longitudinal axes of the piston rods so that applied forces to the strip coincide with the driving plane of the cylinders.

5 Claims, 3 Drawing Figures

GRIPPER FEED SYSTEM FOR BLANKING PRESSES OR THE LIKE

BACKGROUND OF THE INVENTION

This invention relates to a gripper and feeding apparatus for moving materials such as metal sheets or strip in production machines, particularly blanking presses or the like wherein the apparatus includes a gripper carrier guided on slide guides so that the carrier can reciprocate by means of a drive which is actuated by a pressure medium and carries controllable transport grippers for engaging and retaining the material during feeding movement to the press.

A feed mechanism is frequently used to intermittently supply sheet or strip material to a blanking press from which workpieces are stamped. Known feeding mechanisms for this purpose usually comprise two transport grippers for retaining the material during the feeding movement. The grippers are disposed on a carriage or the like forming a slide guide which is guided by two slide rods for longitudinal movement. While the transport grippers are situated in a plane of the material, the drive cylinder used to provide feeding movement is situated beneath the plane of the material. This construction and relationship of parts has a number of disadvantages. One such disadvantage arises from the fact that the point at which the force is applied by the drive cylinder to the material is offset from the plane of the material whereby there is considerable tilting force on the carriage or the like during transmission of a mechanical force. This reduces the force applied to the material, increases wear on the slide guide and also affects the accuracy of the feeding movement of the material. Moreover, regular lubrication is required for the slide guides which increases the cost of servicing the apparatus.

SUMMARY OF THE INVENTION

It is an object of the present invention to provide a gripper feed apparatus for moving material in a production machine in a manner such that it is impossible for tilting forces to occur during the transmission of force to the material required to move the material and consequently, the accompanying disadvantages are obviated.

According to the present invention there is provided apparatus for moving material such as metal sheets or strip in a production machine such as a blanking press or the like wherein the apparatus includes the combination of two spaced-apart and parallel, fluid-actuated, double-acting jacks each including two piston rods extending out of a cylinder in opposite directions from a common piston, the cylinder reciprocating on the piston along an axis extending along the piston rods, means for supporting the ends of the piston rods of the jacks, a cross member for interconnecting the cylinders of the jacks, and at least two transfer grippers each having a gap between gripper elements for engaging the material at opposite sides thereof, the grippers being supported by the cross member in a manner such that the gaps of the grippers lie in a plane extending substantially along the axes of each of the jacks.

In contrast to the known construction for a feed mechanism, the present invention utilizes stationary piston rods and movable cylinders which are connected to form a unit and which form the gripper carrier. The transport grippers are so disposed on the carrier that their openings in the form of a gap are situated centrally in relation to the plane of the axes of the piston rods whereby the driving force is transmitted from the movable cylinders to the material without any tilting forces imposed thereon. An advantage of this arrangement arises out of the fact that no special lubrication is required for the piston rods forming the guide elements because they are continuously lubricated by the fluid-pressure medium. The use of movable feed cylinders also has an important advantage by providing a maximum possible guide length.

According to another advantageous aspect of the present invention, a substantially rectangular base member is positioned parallel to the path of movement and carries upwardly-extending columns at its four corners. The free ends of the piston rods are secured to the columns. A shaft extending transversely to the direction of reciprocating movement of the transport grippers is rotatably mounted on the cylinders of the jacks. A gearwheel is secured to each of the opposite ends of the shaft and the teeth of the gearwheels mesh with a rack disposed along the path of movement of the cylinders to insure absolute synchronism to the movement by the cylinders.

Each of the piston rods has an axially-extending bore that leads into a pressure medium chamber near the piston associated therewith. An electrohydraulic linear amplifier is used for controlling the supply of fluid medium to the pressure chambers in the cylinders. A linear amplifier of this type usually contains a stepping motor employed as a set-value transmitter and a rack and pinion for signaling the actual value from the transmitter. All the functions in this case are controlled by way of a CNC control system. A system of this type operates very accurately, quietly and without any mechanical stops when producing the required feed movement by the jacks.

These features and advantages of the present invention as well as others will be more fully understood when the following description is read in light of the accompanying drawings, in which.

Figure 1:
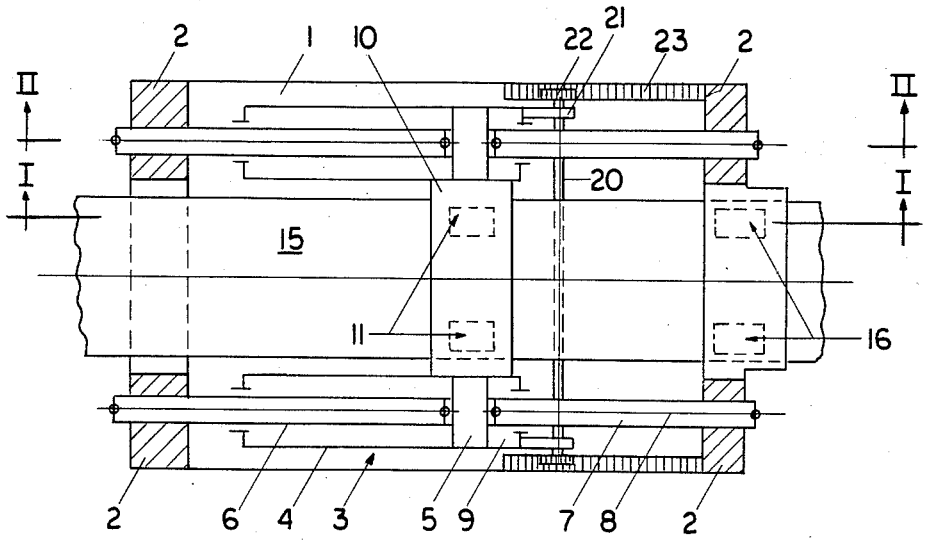
FIG. 1 is a plan view, partly in section, illustrating the gripper feed apparatus according to the present invention.
Figure 2:
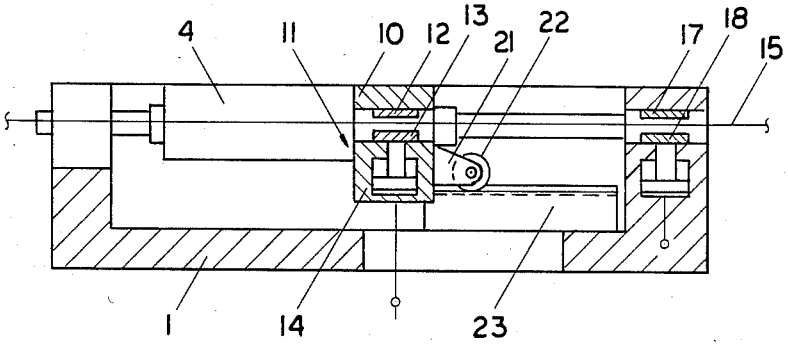
FIG. 2 is a longitudinal section taken along line I—I of FIG. 1.
Figure 3:
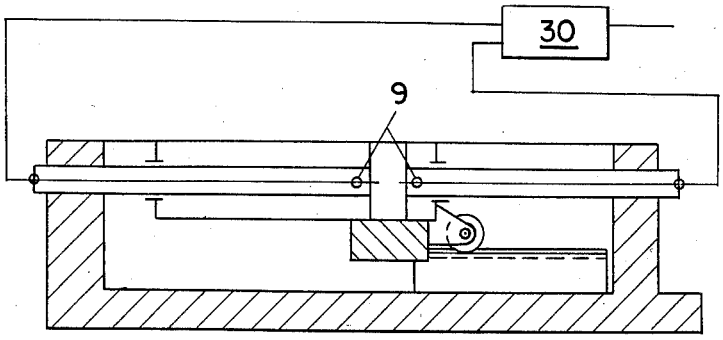
FIG. 3 is a longitudinal section taken along line II—II of FIG. 1.

According to the present invention the gripper feed apparatus illustrated in FIGS. 1–3 includes a rectangular base member 1 having upwardly-extending columns 2 at the four corners of the base member. Two spaced-apart and parallel fluid-actuated, double-acting jacks 3 are supported by the base. As shown in FIG. 1, one of the jacks 3 is provided near each of the two long sides of the base 1. Each jack consists of a cylinder 4, a piston 5 guided in the cylinder and two piston rods 6 and 7 extending from the common piston and emerging from the cylinder 4 at its ends. The free ends of pistons rods 6 and 7 for each jack are clamped to the columns 2 of the base. The cylinder 4 thus forms a reciprocating part of the jacks 3. Each of the piston rod 6 or 7 has an axially-extending bore 8 communicating with a transverse bore 9 leading to the interior of the cylinder near the piston 5. These bores are used for controlling the supply of a fluid medium to the pressure medium chambers in the cylinders 4 for performing the working movement of the apparatus and also for discharging the fluid medium from the pressure chambers on the respective sides of the pistons. Any suitable known control system can be used for controlling the supply and discharge of the fluid medium in the chambers. A very suitable control system, may, for example, take the form of an electrohydraulic linear amplifier 30. One advantage of such an amplifier is that it operates without mechanical stops and, therefore, very quietly.

The longitudinally-movable cylinders 4 of the jacks are rigidly interconnected by a cross member 10. Two grippers 11 actuated by a fluid-pressure medium are disposed on the cross member 10. Each gripper 11 comprises a stationary jaw 12 and a movable jaw 13 connected to the piston rod of a jack 14. The jacks are supplied with a fluid medium by way of a suitably-operable control system which will be apparent to anyone skilled in the art and not shown in the drawings.

In the inoperative position of the jacks 14, as shown in FIG. 2, there is a gap between the jaws 12 and 13. A metal strip 15 for treatment in a production machine such as a blanking press is passed through the gap between the jaws for feeding into the production machine in a direction from left-to-right as one views FIG. 1. Two retaining grippers 16 also actuated by a fluid-pressure medium are provided at the end of the base 1 which is adjacent the production machine for retaining the strip material 15 against movement for the next operation after the material has been moved into the treatment position. The retaining grippers 16 each includes a stationary jaw 17, a movable jaw 18 and a jack 19.

As shown in FIG. 2, the gap between jaws 12 and 13 of grippers 11 is situated centrally in relation to the axial plane of the jacks 3 such that the points of application of the forces by the grippers 11 to the strip material are situated in the same plane as the plane in which the means for producing the force is situated, i.e., the movable cylinders 4. The longitudinal axes of the piston rods 6 and 7 for the jacks lie substantially in a plane which also contains the gap between the grippers and the strip material. By this arrangement, the drive system for the apparatus is free of any undesirable tilting forces of the kind which occurs in known forms of gripper feed mechanisms.

In order to obviate any deviation in the working movement of the cylinders 4 due to production inaccuracies or difference in the supply of the pressurized fluid medium, a mechanical synchronization guide is provided. As shown in FIGS. 1–3, the guide includes a shaft 20 extending transversely to the direction of movement by the cylinders. The shaft is mounted in bearing brackets 21 secured to the cylinders and freely rotates in the bearing brackets. A gearwheel 22 is secured to each end of the shaft 20 to rotate therewith. The gearwheels 22, in turn, have teeth that mesh with teeth on a rack 23 which is secured to the base 1 and thus insures the required synchronous movement by the cylinders 4.

The gripper feed apparatus operates by moving the cylinders 4 to an initial position. Before feeding movement is initiated, the jacks 14 are actuated such that the strip member 15 is clamped between jaws 12 and 13. A pressurized supply of a fluid medium is then fed by way of a central control system through bores 8 and 9 to the pressure medium cylinders on the right-hand side of the pistons 5 as one views FIGS. 1–3 of the drawings. The cylinders 4 move to the right and thus provide feeding movement for the strip material 15 toward the production machine. The feeding movement is completed by interrupting the supply of the pressurized fluid medium.

After completion of the feeding movement, the jacks 11 are disengaged and the jaws 12 and 13 release the strip material 15 so that the cylinders 4 can be returned to their initial position. Before or simultaneously with the disengagement of jacks 11 from the strip, the jacks 19 of the retaining grippers 16 are actuated to retain the strip material in the predetermined position. Upon completion of the processing of the strip in the production machine, and before the next feeding movement of the strip is initiated, the jacks 19 are disengaged so that the retaining grippers 16 are released from the strip. Thereafter, grippers 11 are again energized to grip the strip and execute the cycle for feeding the strip to the production machine as described above.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. Apparatus for moving material such as metal sheets or strip in a production machine such as a blanking press or the like, said apparatus including the combination of:

two spaced-apart and parallel, fluid-actuated, double-acting jacks each including two piston rods extending out of a cylinder in opposite directions from a common piston, said cylinder reciprocating on the piston along an axis extending along said piston rods, means for supporting the ends of the piston rods of said jacks, a cross member rigidly interconnecting the cylinders of said jacks, and at least two transport grippers each including two gripper elements having an adjustable gap therebetween supported by said cross member between the cylinders of said jacks, each of said grippers further including an actuator supported by said cross member to move the gripper elements into engagement with the material at opposite sides thereof by closing a gap between the gripper elements, which gap extends in a plane containing said axis of each of said jacks.

2. The apparatus according to claim 1 wherein said means for supporting includes a substantially rectangular base positioned in a spaced and generally parallel position to the path of movement of the cylinders of said jacks, and columns extending upwardly from four corners of said base for securing the free ends of said piston rods thereto.

3. The apparatus according to claim 1 wherein said piston rods of said jacks each has an axially-extending bore leading to a pressure chamber for supplying and discharging a pressure medium near the piston.

4. The apparatus according to claim 1 further including a shaft rotatably supported by the cylinders of said jacks to extend transversely to the axes of said jacks, gearwheels secured to opposite ends of said shaft, and a stationary rack means having teeth for meshing engagement with teeth of said gearwheels.

5. The apparatus according to claim 1 further including an electrohydraulic linear amplifier for controlling a supply of pressure medium to each of said cylinders of said jacks.

* * * * *